US008286267B2

(12) United States Patent
Zuckerberg

(10) Patent No.: US 8,286,267 B2
(45) Date of Patent: Oct. 16, 2012

(54) DECORATIVE BAND HAVING AN ADJUSTABLE CIRCUMFERENCE

(76) Inventor: Courtnie Marie Zuckerberg, Westport, CT (US)

( * ) Notice: Subject to any disclaimer, the term of this patent is extended or adjusted under 35 U.S.C. 154(b) by 200 days.

(21) Appl. No.: 12/753,092

(22) Filed: Apr. 1, 2010

(65) Prior Publication Data

US 2010/0251461 A1 Oct. 7, 2010

Related U.S. Application Data

(60) Provisional application No. 61/166,570, filed on Apr. 3, 2009.

(51) Int. Cl.
*A41D 27/08* (2006.01)

(52) U.S. Cl. ..... 2/244; 2/269; 2/333

(58) Field of Classification Search ..... 2/332, 240, 2/244, 312, 311, 313, 336, 338, 333, 269, 2/69; 24/3.1, 3.11, 42, 72.1
See application file for complete search history.

(56) References Cited

U.S. PATENT DOCUMENTS

| | | | | | |
|---|---|---|---|---|---|
| 1,023,864 | A * | 4/1912 | Miller | 2/232 |
| 2,065,936 | A * | 12/1936 | Hardie | 2/240 |
| 2,087,620 | A * | 7/1937 | Lipton | 2/311 |
| 2,480,276 | A * | 8/1949 | Wilkenfeld | 2/232 |
| 2,583,861 | A * | 1/1952 | Lewallen | 2/232 |
| 2,677,829 | A * | 5/1954 | Rothstein et al. | 2/232 |
| 2,688,136 | A * | 9/1954 | Freedman | 2/105 |
| 3,722,001 | A * | 3/1973 | Bailey | 2/269 |
| 4,773,100 | A * | 9/1988 | Kuo | 2/46 |
| 4,825,475 | A * | 5/1989 | Smart | 2/312 |
| 4,896,379 | A * | 1/1990 | Kape | 2/269 |
| 4,999,853 | A * | 3/1991 | Tanner | 2/321 |
| 5,067,177 | A | 11/1991 | Binder | |
| 5,088,128 | A * | 2/1992 | Kape | 2/269 |
| D360,742 | S * | 8/1995 | Wilkins | D2/624 |
| 6,158,057 | A * | 12/2000 | Neumann | 2/312 |
| 6,209,141 | B1 * | 4/2001 | Adeli | 2/239 |
| 6,339,848 | B1 * | 1/2002 | Mayhood et al. | 2/338 |
| 6,701,532 | B1 * | 3/2004 | Glassberg et al. | 2/170 |
| D528,743 | S | 9/2006 | MacMillan | |
| 7,103,921 | B1 * | 9/2006 | Shoemaker | 2/312 |
| 7,181,774 | B2 | 2/2007 | Silver | |
| 7,574,753 | B1 * | 8/2009 | Seyfried | 2/312 |
| 7,748,058 | B2 * | 7/2010 | Steitle | 2/244 |
| 2003/0221244 | A1 | 12/2003 | Liddell | |
| 2006/0277660 | A1 | 12/2006 | MacMillan | |
| 2007/0118957 | A1 * | 5/2007 | Steitle | 2/69 |

OTHER PUBLICATIONS http://www.spgifts.com/caprijeans.htm. Downloaded Mar. 3, 2009. 4 pages.

http://cgi.ebay.com/Girls-Capri-pants-with-interchangeable-cuffs---cute!_WOQQitemZ230328382810 . . . Downloaded Mar. 3, 2009. 8 pages.

* cited by examiner

*Primary Examiner* — Shelley Self
*Assistant Examiner* — Richale Quinn
(74) *Attorney, Agent, or Firm* — Michael D. Downs; Fincham Downs LLC

(57) ABSTRACT

An adjustable band includes a tube of material having an open first end and a second end, and a closing device at the open first end. A portion of the tube adjacent the second end may be inserted into the first end to form the band. The band has an adjustable circumference in accordance with a length of the inserted portion, which is secured to the first end by the closing device.

19 Claims, 6 Drawing Sheets

DECORATIVE BAND HAVING AN ADJUSTABLE CIRCUMFERENCE

CROSS-REFERENCE TO RELATED APPLICATION

The present application claims the benefit of priority of U.S. Provisional Patent Application No. 61/166,570 filed on Apr. 3, 2009, entitled "INTERCHANGEABLE AND ADJUSTABLE CUFFS FOR GARMENTS," which is incorporated by reference in this disclosure in its entirety.

FIELD OF THE DISCLOSURE

This disclosure relates generally to decorative treatments, including but not limited to detachable and adjustable cuffs for pants and shirt sleeves and decorative trimming suitable for fashion accessories and home goods.

BRIEF DESCRIPTION OF THE DRAWINGS

An understanding of embodiments described herein and many of the attendant advantages thereof may be readily obtained by reference to the following detailed description when considered with the accompanying drawings.

DETAILED DESCRIPTION

Figure 1A:
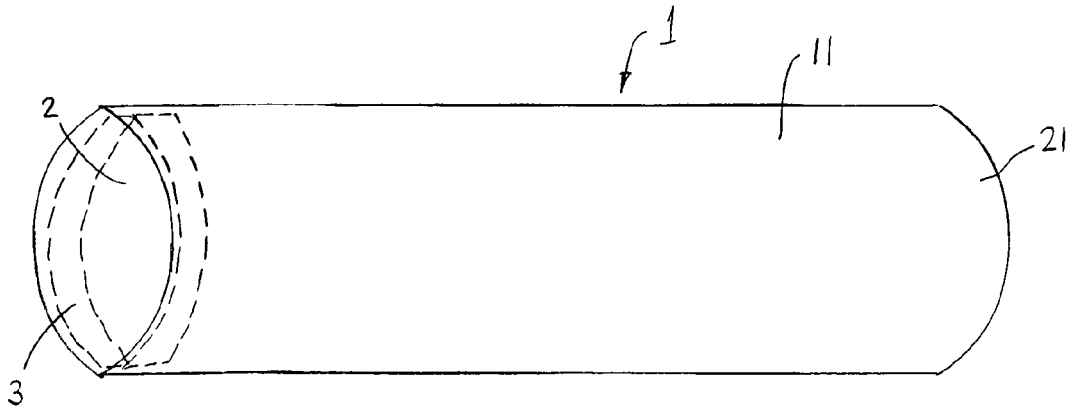
FIG. 1A shows the outside surface of an adjustable band according to an embodiment of the disclosure.

Embodiments discussed in this disclosure are descriptive of apparatus, methods and articles of manufacture for decorative treatments. Applicant has recognized it is desirable to decorate personal and home fashion items in order to make them more attractive and stylish. Furthermore, it is desirable for a consumer to be able to give her favorite items, such as a favorite pair of pants, a different look for different occasions and for different times of the day. Some items, such as pillow cases, shirt sleeves, dresses, and skirts, may have heavily worn areas, such as cuffs or hems, which often need repair prior to the remaining portions of the garment. Furthermore, some garments and home goods are often overlooked with respect to decorative features. Accordingly, it is also desirable for a consumer to be able to both repair decoratively enhance garments such as shirt sleeves, dresses, jackets, and skirts, or items such as lamp shades, table cloths, hats, pillowcases, towels, purses and handbags.

According to some embodiments described in this disclosure, an adjustable band comprises a tube of material (e.g., fabric) having an open first end and a second end, and a closing device at the open first end. In one embodiment, insertion of a portion of the tube adjacent the second end into the first end forms the band with an interior surface and an exterior surface, the portion being securable to the first end by the closing device, and the band has an adjustable circumference in accordance with a length of the portion. For example, the circumference of a band formed by inserting the second end into the first end may be adjusted by adjusting how much material (starting from the second end of the tube) is inserted into the first end. In one embodiment, the closing device comprises a spring frame closure through which the material of the second end is inserted.

According to another embodiment, an adjustable band comprises a tube of material having an open first end and a second end, and a closing device at the open first end. The closing device is effective to secure the material at a desired location to provide a band with an adjustable circumference. For example, a user may set the band to a desired circumference by opening the closing device, inserting a corresponding length of material from the second end into the open first end to achieve the desired circumference, and closing the closing device to secure the material at the desired location.

According to another embodiment, a detachable cuff for a garment comprises a tube of material having an open first end and a second end; a closing device at the open first end; and a plurality of fasteners on one surface of the tube for fastening to the garment. A portion of the tube adjacent the second end is inserted into the first end to form the cuff; the cuff thus has an interior surface and an exterior surface, with the fasteners being disposed on the interior surface. The cuff has an adjustable circumference in accordance with a length of the inserted portion, which is secured to the first end by the closing device. The closing device may be secured to an interior of the tube; in an embodiment, the closing device comprises a spring frame closure. The fasteners may include at least one of buttons, hooks and eyelets, hook and loop material, safety pins, magnetic strips and mitten grips.

According to another embodiment, a kit for an adjustable band comprising a first set of fastening mechanisms for removable attachment to a garment and a closing device for securing material, wherein the first set of fastening mechanisms are configured for attachment to the material, and the closing device is effective to secure the material at a desired location to provide a band with an adjustable circumference. In one embodiment, the closing device is for securing fabric material inserted through the closing device. In another embodiment, the kit comprises a second set of fastening mechanisms for engaging with the first set of fastening mechanisms.

The foregoing has outlined, rather broadly, some preferred features of the present disclosure so that those skilled in the art may better understand the detailed description of the disclosure that follows. Additional features will be described hereinafter, including in the claims of the disclosure. Those skilled in the art should appreciate that they can readily use the disclosed conception and specific embodiments as a basis for designing or modifying other structures, articles and processes for carrying out the various embodiments of the present disclosure and that such other embodiments do not depart from the spirit and scope of the disclosure in its broadest form.

In accordance with various embodiments, a band constructed according to the disclosure may comprise a tube of material, such as fabric, open at one end, which can be closed on itself to form a band with an adjustable circumference, easily attachable to and detachable from an item, such as a garment. More specifically, the band may be viewed as an interfaced adjustable casing attachable to the bottom of a pants leg, end of a shirt sleeve, or end of another garment such as a dress or skirt to appear as a cuff, or attachable to other items such as a lamp shade, table cloth, hat or other item to appear as a decorative trimming.

Although numerous references are made in the following examples to the embodiment of the adjustable band as a "cuff" for a garment comprising a fabric tube, this is for convenience only and is not to be understood as a limit on the described adjustable band or kit for an adjustable band. For example, the adjustable band may be used with garments as other than a cuff specifically, including as a decorative arm or leg band, and, as described herein, a band may be used with various items other than garments, including fashion accessories such as hats and handbags, and items such as lamp shades, table cloths, hats, pillowcases, towels, purses and handbags. In other embodiments, the tube may comprise, in addition to or in place of fabric, other types of materials such as plastic, rubber, cardboard or the like, as deemed suitable for the decorative purpose. Other embodiments are described in this disclosure and still others within the spirit and scope of this disclosure will be understood by those skilled in the art upon contemplation of the disclosure.

FIG. 1A shows an exemplary embodiment of a band 1 as a tube (e.g., a tube of fabric) with an open end 2; the other end 21 is typically, but not always, closed. In FIG. 1A, the outside surface 11 of the tube is shown; the inside surface 12 of the tube (that is, the back side of the tube) is hidden. A closure or closing device 3 is attached to the tube at the open end 2, such as by sewing the closing device 3 into the tube. According to one embodiment, the closing device 3 comprises a spring frame closure, spring clip, clamp or other device capable of securing or holding the material of the tube.

In some embodiments, the tube comprises fabric, and closing device 3 is generally covered with fabric, with the fabric folded over in the interior of the tube and secured (e.g., with a straight stitch), so that neither the closing device 3 (e.g., a spring frame closure) nor the end of the fabric is visible.

It will be understood that by reference to "securing", "secured" or "holding", or variations thereof, it is not required that any material held or secured by the described closing device is incapable of being moved (e.g., if the closing device is closed), or is incapable of being moved in or removed from the closing without great effort, although use of the terms encompasses those meanings as well. In some embodiments, based on how tightly the closing device closes on the material, material that is secured or held may offer resistance to movement of the material (e.g., sufficient to avoid the material moving as a result of typical use of the band or decorated item) but the material may still be movable with sufficient force, such as by a user pulling some of the portion of the material inserted through open end 2 back out of the open end 2. In accordance with some embodiments, the resistance to movement provided by the closing device may allow advantageously for adjustments to the length of the portion inserted in the open end of the tube to achieve a desired circumference of the band (e.g., by expanding the band), or for removing the inserted portion completely, without requiring the closing device be fully opened or disengaged.

Figure 1B:
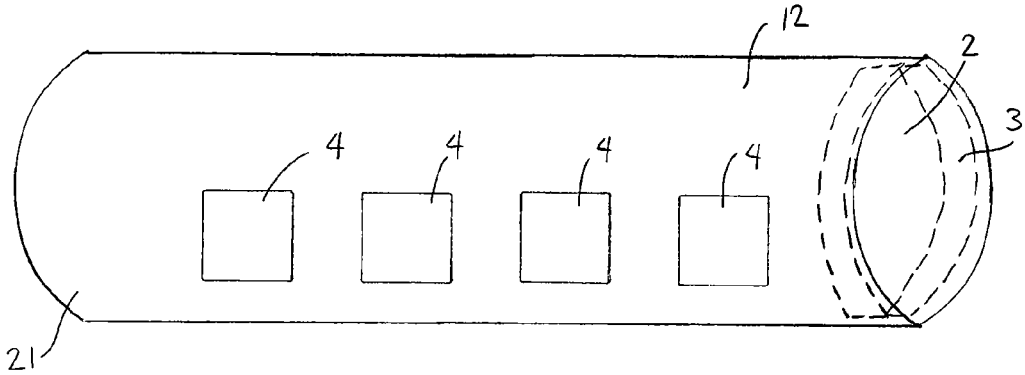
FIG. 1B shows the inside surface of the adjustable band of FIG. 1A, with fasteners illustrated schematically, according to an embodiment of the disclosure.

In FIG. 1B, the exemplary tube of FIG. 1A has been flipped over to show the back side of the tube—that is, the inside surface 12 of the tube; the inside surface 12 faces the item to which it is to be attached (e.g., a garment).

According to some embodiments, an adjustable band may be secured to an item, such as may be desirable for utilizing the band as a cuff for a garment, with any desired number of a variety of optional fasteners 4. FIG. 1B depicts four such fasteners 4, but it will be understood that an adjustable band contemplated by this disclosure may have no fasteners, or more or less than the number of fasteners illustrated in FIG. 1B. Various arrangements for fastening a cuff to a garment are detailed below.

Figure 2A:
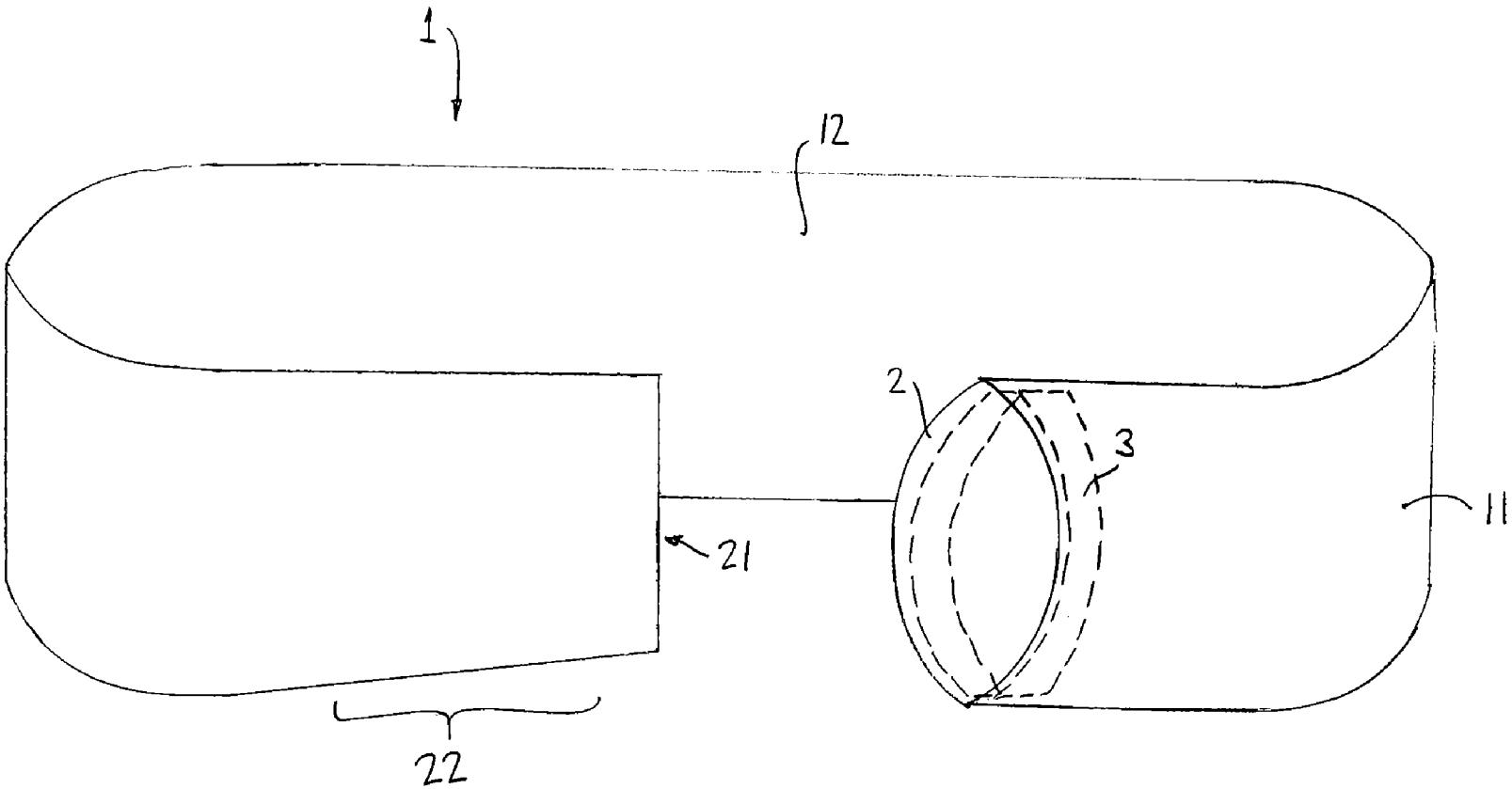
FIG. 2A shows a tube being closed on itself, to form a band with adjustable circumference in accordance with an embodiment of the disclosure.

To form an adjustable band having a circumference to match a pants leg or other garment or item, the tube is closed on itself by inserting a portion 22 of the tube adjacent end 21 into open end 2 (see FIG. 2A). Closing device 3 (e.g., a spring frame closure) closes on the inserted portion 22 of the tube at any desired location, thereby providing adjustable circumference of the band 1. The tube may advantageously be tapered at portion 22, to provide a neat appearance after closure 3 is closed and the band is formed. The only visible seam-like edge is the edge of opening 2 (see FIG. 2B). Accordingly, some embodiments provide for a self-seaming decorative band having a seam-like edge formed by the insertion of one end of a tube of material into an open end of the tube. Although not shown in FIG. 2A or 2B, one or more optional fasteners may be provided on the inside surface 12. The outside surface 11 may be finished and decorated in any manner desired.

It will be appreciated that a tube may be made any length desired, and that the end 21 is freely adjustable with respect to closure 3; the circumference of the band may therefore be made any size desired. Accordingly, adjustable band 1 may be used as a cuff with any type or size of pants. Furthermore, a cuff according to the disclosure may be attached to other types of garments (e.g. skirts, dresses, jackets, shirt sleeves, etc.).

Figure 2B:
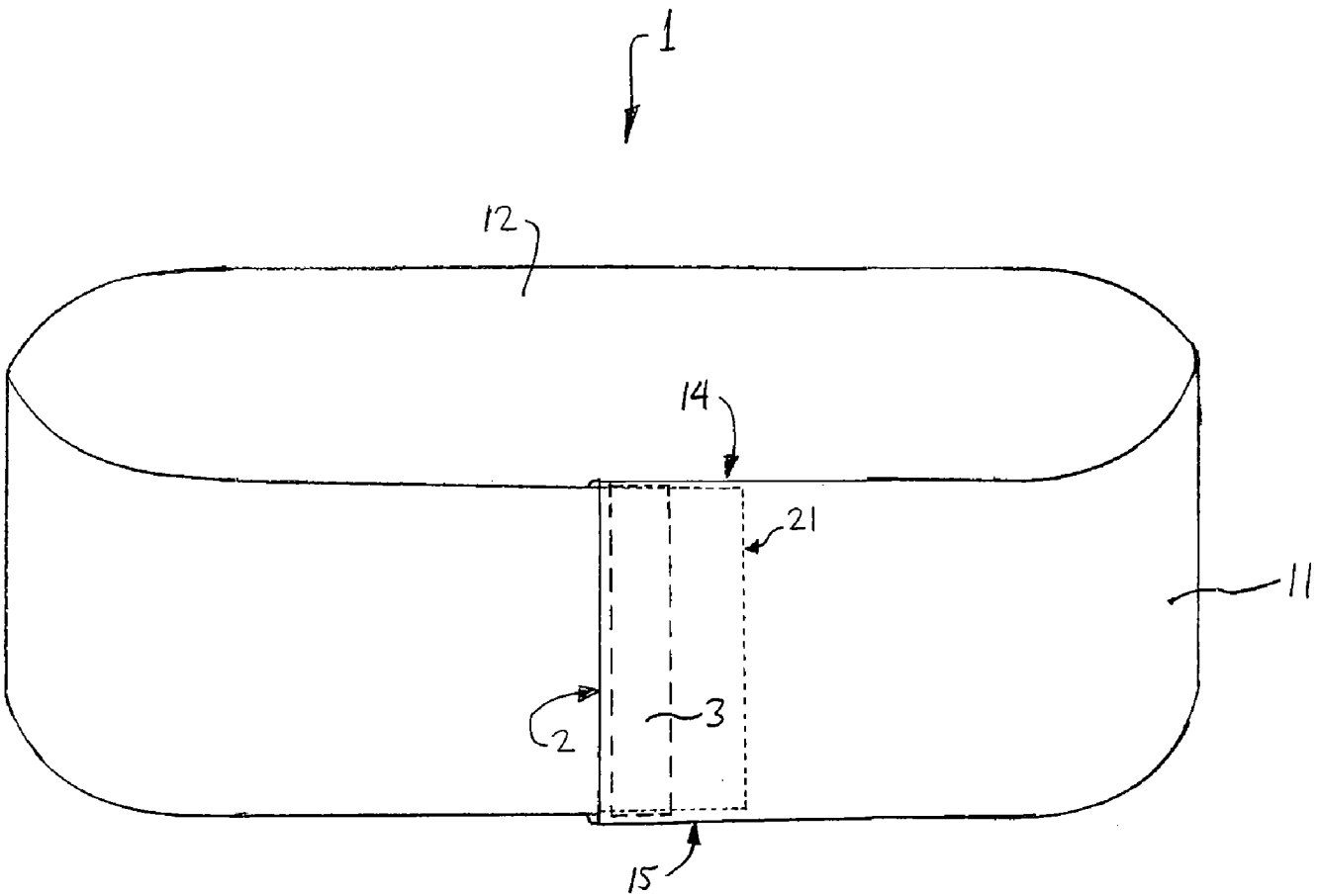
FIG. 2B shows a band with an adjustable circumference, in accordance with an embodiment of the disclosure.

The width of the band (that is, the distance between top edge 14 and bottom edge 15, as shown in FIG. 2B, given by the width of the tube) may also be any size desired. Bands of progressively greater widths may thus be used, in accordance with some embodiments, as cuffs to extend the length of a garment (e.g., to lengthen a child's favorite pair of pants as the child experiences a growth spurt, and thereby also extend the wearable life of the garment).

Figure 3:
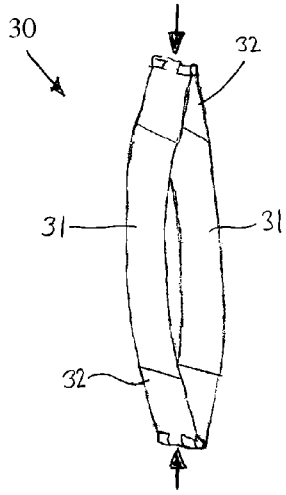
FIG. 3 illustrates a spring frame closure used to secure material of a band on itself, in accordance with one embodiment of the disclosure.

An exemplary spring frame closure 30, shown in FIG. 3, includes two spring metal strips 31 connected to hinges 32. The closure is opened by pushing the hinges towards each other, in the direction of the arrows shown. When closed, the strips 31 lie flat and parallel, and are effective to hold the fabric or other material of the end portion of the tube (such as near end 21 of FIG. 2A) between them.

Some additional embodiments are discussed now in more detail with respect to using an adjustable band as a cuff for a garment. FIGS. 4A-4D depict some exemplary embodiments of adjustable bands utilizing different types of fastening devices. In accordance with one embodiment, a plurality of buttons 41 on the inside surface 12 may be used to secure a cuff to a garment or other item (see FIG. 4A). In some embodiments, four buttons may be used to attach a cuff. In one embodiment, it may be necessary to cut four corresponding holes in the garment for the buttons. In another embodiment, a user may apply a patch (e.g., an iron-on patch) to the inside of a garment to prevent the fabric of the garment from fraying. Preferably, neither the buttons nor the button holes in the garment are visible while the cuff is attached.

Figure 5:
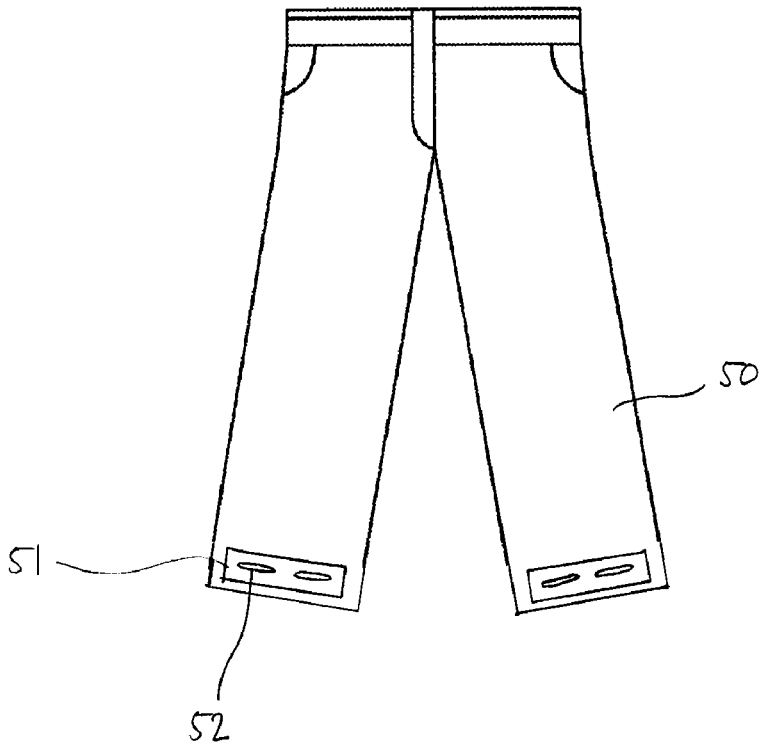
FIG. 5 illustrates a pair of pants with patches having buttonholes, suitable for attaching to the cuffs of FIG. 4A, in accordance with an embodiment of the disclosure.

In other embodiments, removable iron-on patches that include fastening mechanisms such as buttons, hook and eyelet fasteners, fasteners of hook and loop material, snaps, pins, or other known fasteners, can be applied to the outside of a garment. For example, patches 51 including buttonholes 52 may be ironed onto the legs of pants 50 (see FIG. 5), to permit attachment of a cuff using buttons 41. In such embodiments, systems utilizing cuffs according to the disclosed subject matter can be used without damaging the garment and the garment can be restored to a condition similar to before attaching the cuffs.

In other embodiments, a consumer is provided with the closure 3, and optionally fasteners 4 together with iron-on items as discussed above, in a kit for making a cuff or other type of band; the consumer provides the fabric for the band, and any decoration, as desired. For example, such a kit may contain iron-on patches 51 having buttonholes 52 formed therein, buttons 41 and a spring closure 3.

In some embodiments, safety pins 42 are secured to the interior of the cuff (see FIG. 4B), and may easily secure the cuff to a garment. At least two safety pins are preferred, as is generally known, but any number and size(s) of safety pins may be used.

Figure 4A:
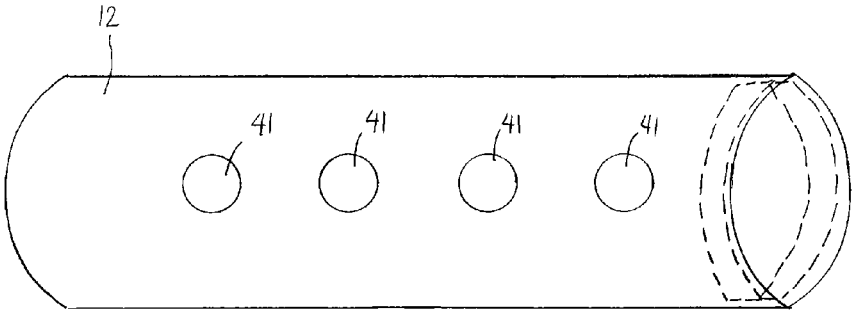
FIG. 4A schematically illustrates a cuff having buttons for attachment to a garment, in accordance with an embodiment of the disclosure.
Figure 4B:
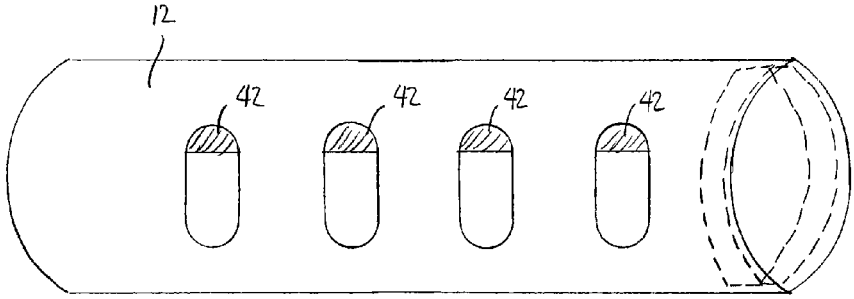
FIG. 4B schematically illustrates a cuff having safety pins for attachment to a garment, in accordance with an embodiment of the disclosure.
Figure 4C:
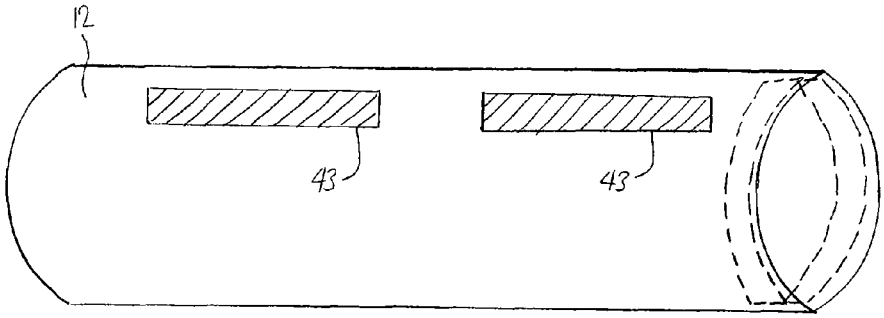
FIG. 4C schematically illustrates a cuff having magnetic strips for attachment to a garment, in accordance with an embodiment of the disclosure.

In some embodiments, the cuff is secured to a garment using magnetic strips. As shown in FIG. 4C, magnetic strips 43 are secured (e.g., with glue) to the inside surface 12 of the cuff; corresponding strips are secured to the inside of the garment. This arrangement has the advantage of being invisible from the outside, whether the cuff is attached or detached.

Figure 4D:
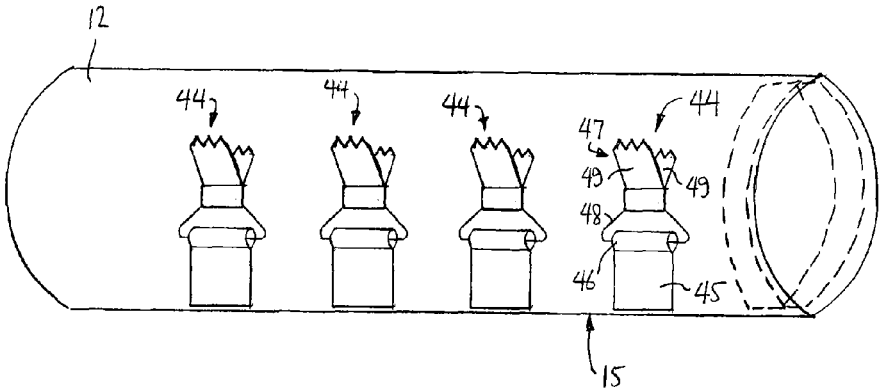
FIG. 4D schematically illustrates a cuff having mitten clips for attachment to a garment, in accordance with an embodiment of the disclosure.

In some embodiments, shown in FIG. 4D, the cuff may be secured to a garment using mitten grippers, sometimes called "mitten clips," "suspender clips" or "gator clips." A plurality of fastener arrangements 44 (four in this embodiment) including grippers 47 are secured to the inside surface 12 of the cuff. According to the embodiment depicted in FIG. 4D, a tab 45 of grosgrain ribbon, located near the bottom edge 15 of the cuff, is applied to the inside surface 12 of the cuff; grosgrain ribbon has the advantages of being self-finished and having a selvage edge. The tab is formed by turning a length of the ribbon on itself to form two thicknesses with a loop 46 at the upper end of the tab. The tab is top-stitched to the fabric of the cuff. The loop 46 is used to capture the wire base 48 of gripper 47. The jaws 49 of gripper 47 are opened and closed by an actuator tab (not shown), which may be covered by another length of ribbon (e.g., an extension of the ribbon of tab 45) to provide a neat appearance. In this embodiment, when the cuff is turned on itself and closed (as shown in FIG. 2B), two grippers 47 are located at the front side and rear side of the pants leg respectively. The grippers then secure the cuff to the bottom edge of the garment. This arrangement has the advantage of being invisible from the outside, whether the cuff is attached or detached. This arrangement has the additional advantage of not requiring any modification of the garment. Furthermore, it will be appreciated that if the ribbon of tab 45 is used to cover gripper 47, only the ribbon will show on the inside of the cuff.

Figure 6:
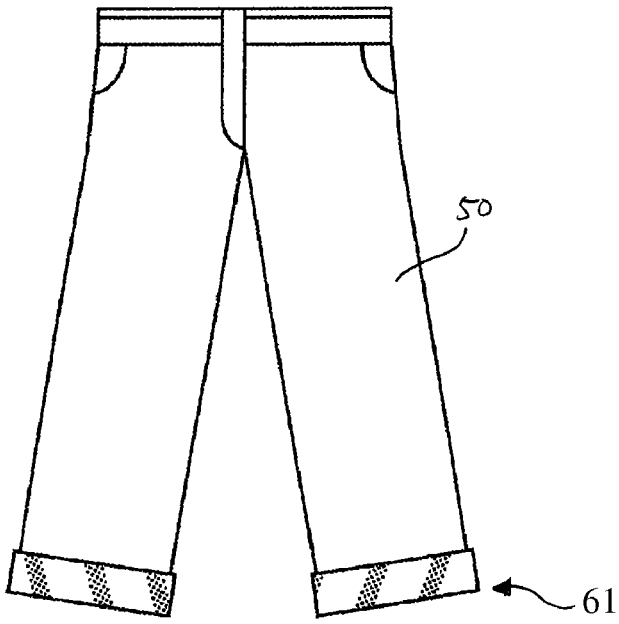
FIG. 6 illustrates cuffs attached to a pair of pants in accordance with an embodiment of the disclosure.

FIG. 6 illustrates cuffs 61 attached to legs of pants 50. As depicted, any fasteners that may be used to attach the cuffs are not visible; the seam-like edge in the cuff (open end 2 of the casing) is located at the rear of the pants leg and not visible from the front. Accordingly, cuffs 61 present a neat and attractive appearance.

While the disclosure has been described in terms of specific embodiments, it is evident in view of the foregoing description that numerous alternatives, modifications and variations will be apparent to those skilled in the art. Accordingly, the disclosure is intended to encompass all such alternatives, modifications and variations which fall within the scope and spirit of the disclosure and the following claims.

Numerous embodiments are described in this patent application, and are presented for illustrative purposes only. The described embodiments are not, and are not intended to be, limiting in any sense. The presently disclosed invention(s) are widely applicable to numerous embodiments, as is readily apparent from the disclosure. One of ordinary skill in the art will recognize that the disclosed invention(s) may be practiced with various modifications and alterations. Although particular features of the disclosed invention(s) may be described with reference to one or more particular embodiments and/or drawings, it should be understood that such features are not limited to usage in the one or more particular embodiments or drawings with reference to which they are described, unless expressly specified otherwise.

The present disclosure is neither a literal description of all embodiments of the invention nor a listing of features of the invention that must be present in all embodiments.

Neither the Title (set forth at the beginning of the first page of this patent application) nor the Abstract (set forth at the end of this patent application) is to be taken as limiting in any way the scope of the disclosed invention(s).

The terms "an embodiment", "embodiment", "embodiments", "the embodiment", "the embodiments", "one or more embodiments", "some embodiments", "one embodiment" and the like mean "one or more (but not all) disclosed embodiments", unless expressly specified otherwise.

A reference to "another embodiment" in describing an embodiment does not imply that the referenced embodiment is mutually exclusive with another embodiment (e.g., an embodiment described before the referenced embodiment), unless expressly specified otherwise.

The terms "including", "comprising" and variations thereof mean "including but not limited to", unless expressly specified otherwise.

The terms "a", "an" and "the" mean "one or more", unless expressly specified otherwise.

The term "plurality" means "two or more", unless expressly specified otherwise.

The term "herein" means "in the present application, including the specification, its claims and figures, and anything which may be incorporated by reference", unless expressly specified otherwise.

The phrase "at least one of", when such phrase modifies a plurality of things (such as an enumerated list of things) means any combination of one or more of those things, unless expressly specified otherwise. For example, the phrase at least one of a widget, a car and a wheel means either (i) a widget, (ii) a car, (iii) a wheel, (iv) a widget and a car, (v) a widget and a wheel, (vi) a car and a wheel, or (vii) a widget, a car and a wheel.

The phrase "based on" does not mean "based only on", unless expressly specified otherwise. In other words, the phrase "based on" describes both "based only on" and "based at least on".

Where a limitation of a first claim would cover one of a feature as well as more than one of a feature (e.g., a limitation such as "at least one widget" covers one widget as well as more than one widget), and where in a second claim that depends on the first claim, the second claim uses a definite article "the" to refer to the limitation (e.g., "the widget"), this does not imply that the first claim covers only one of the feature, and this does not imply that the second claim covers only one of the feature (e.g., "the widget" can cover both one widget and more than one widget).

When an ordinal number (such as "first", "second", "third" and so on) is used as an adjective before a term, that ordinal number is used (unless expressly specified otherwise) merely to indicate a particular feature, such as to allow for distinguishing that particular referenced feature from another feature that is described by the same term or by a similar term. For example, a "first widget" may be so named merely to allow for distinguishing it in one or more claims from a "second widget", so as to encompass embodiments in which (1) the "first widget" is or is the same as the "second widget" and (2) the "first widget" is different than or is not identical to the "second widget". Thus, the mere usage of the ordinal numbers "first" and "second" before the term "widget" does not indicate any other relationship between the two widgets, and likewise does not indicate any other characteristics of either or both widgets. For example, the mere usage of the ordinal numbers "first" and "second" before the term "widget" (1) does not indicate that either widget comes before or after any other in order or location; (2) does not indicate that either widget occurs or acts before or after any other in time; (3) does not indicate that either widget ranks above or below any other, as in importance or quality; and (4) does not indicate that the two referenced widgets are not identical or the same widget. In addition, the mere usage of ordinal numbers does not define a numerical limit to the features identified with the ordinal numbers. For example, the mere usage of the ordinal numbers "first" and "second" before the term "widget" does not indicate that there must be no more than two widgets.

When a single device or article is described herein, more than one device or article (whether or not they cooperate) may alternatively be used in place of the single device or article that is described. Accordingly, the functionality that is described as being possessed by an article may alternatively be possessed by more than one article (whether or not they cooperate).

Similarly, where more than one device or article is described herein (whether or not they cooperate), in some embodiments a single device or article may alternatively be used in place of the more than one device or article that is described. For example, a plurality of fastening devices may be substituted with a single fastening device. Accordingly, the functionality described as being provided by more than one device or article may, in some embodiments, alternatively be provided by a single device or article.

The functionality and/or the features of a single device that is described may be alternatively embodied by one or more other devices which are described but are not explicitly described as having such functionality and/or features. Thus, other embodiments need not include the described device itself, but rather can include the one or more other devices which would, in those other embodiments, have such functionality or features.

A description of an embodiment with several components or features does not imply that all or even any of such components and/or features are required. On the contrary, a variety of optional components are described to illustrate the wide variety of possible embodiments of the present invention(s). Unless otherwise specified explicitly, no component and/or feature is essential or required. Unless otherwise specified explicitly, a listing of alternatives or specific examples for a given feature, limitation or component, is to be understood as describing explicitly embodiments in which one or more of the listed alternatives is not present or provided. For example, a description that a fastening device may be a button, snap or clamp may be understood as explicitly describing an embodiment of the fastening device that does not comprise any snaps.

Further, although process steps, algorithms or the like may be described in a sequential order, such processes may be configured to work in different orders. In other words, any sequence or order of steps that may be explicitly described does not necessarily indicate a requirement that the steps be performed in that order. The steps of processes described herein may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to the invention, and does not imply that the illustrated process is preferred.

Although a process may be described as including a plurality of steps, that does not indicate that all or even any of the steps are essential or required. Various other embodiments within the scope of the described invention(s) include other processes that omit some or all of the described steps. Unless otherwise specified explicitly, no step is essential or required.

Although a product may be described as including a plurality of components, aspects, qualities, characteristics and/or features, that does not indicate that all of the plurality are essential or required. Various other embodiments within the scope of the described invention(s) include other products that omit some or all of the described plurality.

An enumerated list of items (which may or may not be numbered) does not imply that any or all of the items are mutually exclusive, unless expressly specified otherwise. Likewise, an enumerated list of items (which may or may not be numbered) does not imply that any or all of the items are comprehensive of any category, unless expressly specified otherwise. For example, the enumerated list "a dress, a shirt, a skirt" does not imply that any or all of the three items of that list are mutually exclusive and does not imply that any or all of the three items of that list are comprehensive of any category.

Headings of sections provided in this patent application and the title of this patent application are for convenience only, and are not to be taken as limiting the disclosure in any way.

"Determining" something can be performed in a variety of manners and therefore the term "determining" (and like terms) includes calculating, computing, deriving, looking up (e.g., in a table, database or data structure), ascertaining and the like.

The present disclosure provides, to one of ordinary skill in the art, an enabling description of several embodiments and/or inventions. Some of these embodiments and/or inventions may not be claimed in the present application, but may nevertheless be claimed in one or more continuing applications that claim the benefit of priority of the present application. Applicants reserve the right to file one or more additional applications to pursue patents for subject matter that has been disclosed and enabled but not claimed in the present application.

What is claimed is:

1. An adjustable band, comprising:

a tube of material having an open first end and a second end; and a closing device at the open first end, wherein the closing device is secured to an interior of the tube, wherein the closing device comprises a spring frame closure, the spring frame closure comprising two metal strips, each having a first end and a second end, the two first ends of the metal strips connected by a first hinge, the two second ends of the metal strips connected by a second hinge, wherein insertion of a portion of the tube adjacent the second end into the first end forms the band with an interior surface and an exterior surface, the band having an adjustable circumference in accordance with a length of the portion, the portion being securable to the first end by the closing device by the metal strips of the spring frame closure holding the portion of the tube between them when the spring closure is closed.

2. The adjustable band of claim 1, wherein insertion of the portion of the tube adjacent the second end into the first end forms a cuff for a garment.

3. The adjustable band of claim 2, wherein the garment comprises at least one of pants, a pant leg, a shirt, a shirt sleeve, a skirt, a jacket, and a dress.

4. The adjustable band of claim 1, wherein insertion of the portion of the tube adjacent the second end into the first end forms a removably attachable trimming.

5. The adjustable band of claim 4, wherein the trimming is removably attachable to at least one of a lamp shade, a table cloth, a hat, a pillowcase, a towel, a purse and a handbag.

6. The adjustable band of claim 1, further comprising a plurality of fasteners on one surface of the tube.

7. The adjustable band of claim 6, wherein the fasteners are for fastening the band to a garment.

8. The adjustable band of claim 6, wherein the fasteners include at least one of buttons, safety pins, hooks and eyelets, hook material for fastening to loop material, loop material for fastening to hook material, magnetic strips and mitten grips.

9. The adjustable band of claim 6 wherein the fasteners are disposed on the interior surface of the tube.

10. The adjustable band of claim 1, the spring frame closure configured to be opened by pushing the hinges towards each other.

11. The adjustable band of claim 1, wherein the spring frame closure is covered by a portion of the open end of the tube of material folded over and into the interior of the tube and secured to the interior of the tube such that the spring frame closure is not visible.

12. An adjustable cuff for a garment, comprising:

a tube of material having an open first end and a second end;

a closing device at the open first end; and a plurality of fasteners on one surface of the tube for fastening to the garment, wherein the closing device is secured to an interior of the tube, wherein the closing device comprises a spring frame closure, the spring frame closure comprising two metal strips, each having a first end and a second end, the two first ends of the metal strips connected by a first hinge, the two second ends of the metal strips connected by a second hinge, wherein a portion of the tube adjacent the second end is inserted into the first end to form said cuff with an interior surface and an exterior surface, the fasteners being disposed on the interior surface, said cuff having an adjustable circumference in accordance with a length of said portion, said portion being securable to the first end by the closing device by the metal strips of the spring frame closure holding the portion of the tube between them when the spring closure is closed.

13. The adjustable cuff of claim 12, wherein the fasteners include at least one of buttons, safety pins, hooks and eyelets, hook material for fastening to loop material, loop material for fastening to hook material, magnetic strips and mitten grips.

14. The adjustable cuff of claim 12, the spring frame closure configured to be opened by pushing the hinges towards each other.

15. The adjustable cuff of claim 12, wherein the spring frame closure is covered by a portion of the open first end of the tube of material folded over and into the interior of the tube and secured to the interior of the tube such that the spring frame closure is not visible.

16. An adjustable band kit, said kit comprising:

a first set of fastening mechanisms for removable attachment to a garment; and a tube of fabric material having an open first end and a second end; and a closing device at the open first end, wherein the closing devices is secured to an interior of the tube; before first occurrence of said closing device for securing fabric material inserted through the closing device, wherein the closing device comprises a spring frame closure, the spring frame closure comprising two metal strips, each having a first end and a second end, the two first ends of the metal strips connected by a first hinge, the two second ends of the metal strips connected by a second hinge, wherein the first set of fastening mechanisms are configured for attachment to the fabric material, and the closing device is effective to secure the fabric material at a desired location to provide a band with an adjustable circumference by the metal strips of the spring frame closure holding the fabric material between them when the spring closure is closed.

17. The adjustable band kit of claim 16, further comprising:

a second set of fastening mechanisms for removable attachment to a garment, wherein the first set of fastening mechanisms are configured further for engagement with the second set of fastening mechanisms.

18. The adjustable band kit of claim 17, wherein the first set of fastening mechanisms includes a plurality of buttons, and the second set of fastening mechanisms includes an iron-on patch for attachment to the garment and having buttonholes for engaging the buttons.

19. The adjustable band kit of claim 16, the spring frame closure configured to be opened by pushing the hinges towards each other.

* * * * *